US011815052B2

(12) United States Patent
Kong et al.

(10) Patent No.: US 11,815,052 B2
(45) Date of Patent: Nov. 14, 2023

(54) EGR COOLER

(71) Applicants: Hyundai Motor Company, Seoul (KR); Kia Corporation, Seoul (KR)

(72) Inventors: Jeongeui Kong, Whasung-Si (KR); Hee Yong Choi, Whasung-Si (KR); Junhee Lee, Whasung-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/891,379

(22) Filed: Aug. 19, 2022

(65) Prior Publication Data

US 2023/0175463 A1 Jun. 8, 2023

(30) Foreign Application Priority Data

Dec. 8, 2021 (KR) ..... 10-2021-0174899

(51) Int. Cl.
*F02M 26/26* (2016.01)
*F02M 26/30* (2016.01)
*F02M 26/32* (2016.01)

(52) U.S. Cl.
CPC ..... *F02M 26/26* (2016.02); *F02M 26/30* (2016.02); *F02M 26/32* (2016.02)

(58) Field of Classification Search
CPC ..... F02M 26/26; F02M 26/30; F02M 26/32
See application file for complete search history.

(56) References Cited

U.S. PATENT DOCUMENTS

| | | | | |
|---|---|---|---|---|
| 9,664,087 | B2 * | 5/2017 | Sloss | F28D 21/0003 |
| 10,221,815 | B1 * | 3/2019 | Jin | F16K 11/00 |
| 10,975,757 | B2 | 4/2021 | Cho et al. | |
| 2005/0199381 | A1 * | 9/2005 | Mercz | F16K 1/222 165/172 |
| 2005/0235972 | A1 | 10/2005 | Yi | |
| 2007/0017489 | A1 * | 1/2007 | Kuroki | F02M 26/25 123/568.18 |
| 2007/0289581 | A1 * | 12/2007 | Nakamura | F02M 26/11 123/568.12 |
| 2019/0249628 | A1 | 8/2019 | Kobayashi | |

FOREIGN PATENT DOCUMENTS

| | | | |
|---|---|---|---|
| JP | 2002-242767 | A | 8/2002 |
| JP | 2013-181394 | A | 9/2013 |
| KR | 10-2010-0116376 | A | 11/2010 |

* cited by examiner

*Primary Examiner* — Xiao En Mo
(74) *Attorney, Agent, or Firm* — MORGAN, LEWIS & BOCKIUS LLP

(57) ABSTRACT

An exhaust gas recirculation (EGR) cooler includes: a housing including a cavity in which a plurality of tubes are received, and including a coolant inlet conduit allowing a coolant to flow into the cavity therethrough and a coolant outlet conduit allowing the coolant to be discharged from the cavity therethrough; a bypass conduit provided in parallel to the housing; an inlet header sealingly mounted on a first end portion of the housing; and an outlet header sealingly mounted on a second end portion of the housing. The inlet header may include an EGR valve housing, a bypass valve housing, and a cooling chamber defined in the EGR valve housing and the bypass valve housing, and the cooling chamber may be fluidly connected to the cavity of the housing through the coolant outlet conduit.

14 Claims, 9 Drawing Sheets

EGR COOLER

CROSS-REFERENCE TO RELATED APPLICATION

The present application claims priority to Korean Patent Application No. 10-2021-0174899, filed on Dec. 8, 2021, the entire contents of which is incorporated herein for all purposes by this reference.

BACKGROUND OF THE PRESENT DISCLOSURE

Field of the Present Disclosure

The present disclosure relates to an exhaust gas recirculation (EGR) cooler, and more particularly, to an EGR cooler integrated with a bypass valve and an EGR valve.

DESCRIPTION OF RELATED ART

Various technologies for reducing exhaust gases such as nitrogen oxides (NOx) are being developed in accordance with vehicle emission regulations, and one thereof is an exhaust gas recirculation (EGR) system that can reduce the emission of NOx contained in the exhaust gases by recirculating some of the exhaust gases to an intake system.

The EGR system may include an EGR conduit connected between an exhaust system of an engine and an intake system of the engine, an EGR valve mounted on the EGR conduit, an EGR cooler mounted on the EGR conduit, a bypass conduit connected to the upstream side and downstream side of the EGR cooler, and a bypass valve mounted on an inlet of the bypass conduit.

The EGR cooler may include a housing through which a coolant passes, a plurality of tubes through which the exhaust gas passes, an inlet header fluidically-communicating with an inlet of each tube, and an outlet header fluidically-communicating with an outlet of each tube. A cooling fin may be provided inside or outside each tube.

In the EGR cooler, a housing of the EGR valve and a housing of the bypass valve may be individually mounted on the inlet header, and a shaft of the bypass valve may be rotatably mounted on the inlet header. At least one end portion of the shaft may be sealingly mounted on the inlet header through a sealing system to prevent leakage of the exhaust gas.

As the high-temperature exhaust gas passes through the inside of the EGR cooler, the sealing system of the bypass valve may be thermally damaged. When the temperature of the exhaust gas exceeds a threshold temperature, the sealing system may be thermally deformed, resulting in the leakage of the exhaust gas.

According to the related art, the housing of the bypass valve may be cooled by air so that the sealing system may be prevented from being thermally deformed by the exhaust gas. However, the cooling performance obtained by the air may be relatively low, and accordingly it may be difficult to effectively prevent the thermal deformation of the sealing system.

According to the related art, a mounting area between the housing of the bypass valve and the EGR cooler may be relatively narrow, and the housing of the bypass valve may be mounted to the EGR cooler using hexagonal wrench bolts, welding, and/or the like, which may result in low mountability of the housing of the bypass valve with respect to the EGR cooler.

Furthermore, the housing of the bypass valve may be partially cooled by a coolant. The housing of the bypass valve may have a coolant chamber provided therein, and the coolant chamber may be connected to a water jacket of the internal combustion engine through a coolant line. The housing of the bypass valve may be mounted to the EGR cooler using the hexagonal wrench bolts. However, as the housing of the bypass valve is mounted to the EGR cooler through the hexagonal wrench bolts, connection stiffness between the housing of the bypass valve and the EGR cooler may be relatively reduced, and accordingly the flow rate and pressure of the coolant may be limited.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing an exhaust gas recirculation (EGR) cooler significantly reducing thermal damage to various components caused by an exhaust gas, and reliably preventing leakage of the exhaust gas.

According to an aspect of the present disclosure, an exhaust gas recirculation (EGR) cooler may include: a housing including a cavity in which a plurality of tubes are received, and including a coolant inlet conduit allowing a coolant to flow into the cavity therethrough and a coolant outlet conduit allowing the coolant to be discharged from the cavity therethrough; a bypass conduit provided in parallel to the housing; an inlet header sealingly mounted on a first end portion of the housing; and an outlet header sealingly mounted on a second end portion of the housing. The inlet header may include an EGR valve housing, a bypass valve housing, and a cooling chamber defined in the EGR valve housing and the bypass valve housing, and the cooling chamber may be fluidly connected to the cavity of the housing through the coolant outlet conduit.

The cooling chamber provided in the inlet header may be fluidly connected to the cavity of the housing so that the coolant may circulate from the cavity of the housing to the cooling chamber. Thus, the plurality of tubes received in the cavity of the housing and the inlet header may be sufficiently cooled by the coolant.

The inlet header may include a first cooling chamber defined in the EGR valve housing, and a second cooling chamber defined in the bypass valve housing.

The first cooling chamber and the second cooling chamber may be defined in the EGR valve housing and the bypass valve housing, respectively, so that the coolant may cool the EGR valve housing and the bypass valve housing individually.

The EGR valve housing may include a valve cavity, and the first cooling chamber may be provided to surround the valve cavity within the EGR valve housing.

As the first cooling chamber is provided to surround the valve cavity within the EGR valve housing, the EGR valve housing may be cooled very efficiently by the coolant passing through the first cooling chamber.

The second cooling chamber may extend from the first cooling chamber toward the housing within the bypass valve housing, and the second cooling chamber may be fluidly connected to the first cooling chamber.

As the second cooling chamber extends from the first cooling chamber toward the housing, the bypass valve housing may be cooled very efficiently by the coolant passing through the second cooling chamber.

The EGR valve housing and the bypass valve housing may form a unitary one-piece structure, and the bypass valve housing may be located on a downstream side of the EGR valve housing in an exhaust gas flow direction.

Considering that the EGR valve housing and the bypass valve housing form a unitary one-piece structure, when the coolant is directed into the cooling chamber, there may be no limit to the ranges of the flow rate and pressure of the coolant and there may be no leakage of the coolant in the cooling chamber.

The inlet header may include a first inlet passage directly fluidically-communicating with the valve cavity of the EGR valve housing, a second inlet passage directly fluidically-communicating with the first inlet passage, a third inlet passage located between the second inlet passage and the cavity of the housing, and a fourth inlet passage located between the second inlet passage and the bypass conduit.

The third inlet passage and the fourth inlet passage may branch off from the second inlet passage, the third inlet passage may directly fluidically-communicate with an inlet of each tube, and the fourth inlet passage may directly fluidically-communicate with the bypass conduit.

The plurality of inlet passages may be integrally provided in the inlet header so that the plurality of inlet passages may allow the exhaust gas to selectively flow to the housing or the bypass conduit.

The EGR cooler may further include a bypass valve assembly mounted in the bypass valve housing, and the bypass valve assembly may include a valve flap, a valve shaft provided on the valve flap, and an actuator connected to the valve shaft.

The second cooling chamber may include a curved portion which is provided to surround the valve shaft.

The bypass valve assembly may further include a valve cover detachably mounted on the bypass valve housing through a fastener, and the valve shaft may be rotatably supported to the valve cover through a sealing system.

The valve flap may be movably mounted in the second inlet passage, and the valve flap may selectively cover the third inlet passage and the fourth inlet passage.

The valve flap may move between a closed position in which the valve flap uncovers the third inlet passage and covers the fourth inlet passage and an open position in which the valve flap covers the third inlet passage and uncovers the fourth inlet passage.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
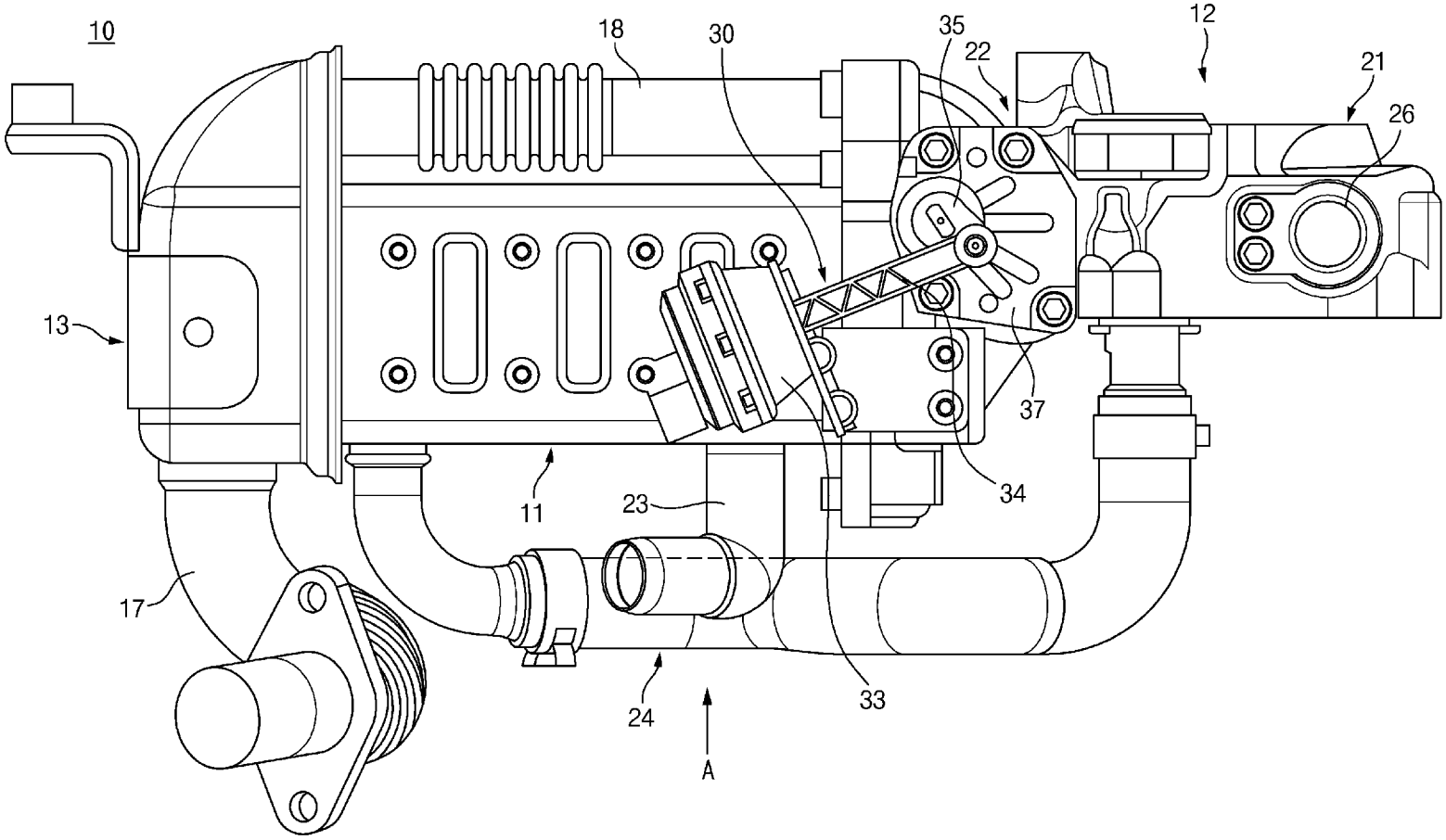
FIG. 1 illustrates an exhaust gas recirculation (EGR) cooler according to an exemplary embodiment of the present disclosure.

It may be understood that the appended drawings are not necessarily to scale, presenting a somewhat simplified representation of various features illustrative of the basic principles of the present disclosure. The specific design features of the present disclosure as disclosed herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Hereinafter, various exemplary embodiments of the present disclosure will be described in detail with reference to the accompanying drawings. In the drawings, the same reference numerals will be used throughout to designate the same or equivalent elements. Furthermore, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 8:
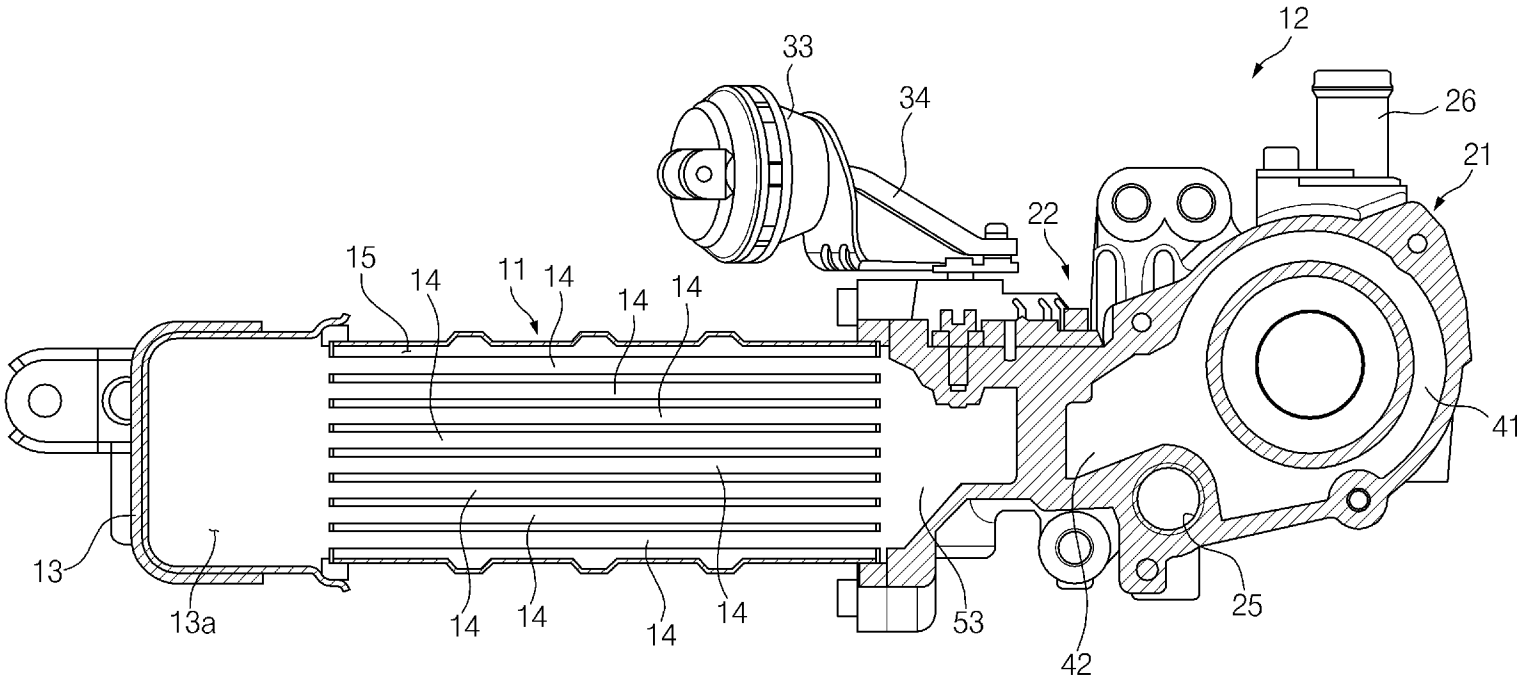
FIG. 8 illustrates a cross-sectional view, taken along line D-D of FIG. 6.

Referring to FIG. 1, an exhaust gas recirculation (EGR) cooler 10 may include a housing 11 and a bypass conduit 18 connected parallel to the housing 11. Referring to FIG. 8, a plurality of tubes 14 may be provided in the housing 11, and the housing 11 may have a cavity 15 in which the plurality of tubes 14 are received. The plurality of tubes 14 may be spaced from each other at regular intervals, and thus a coolant may pass through a gap between the tubes 14.

An inlet header 12 may be sealingly mounted on a first end portion of the housing 11, and the inlet header 12 may include an EGR valve housing 21 and a bypass valve housing 22. The EGR valve housing 21 and the bypass valve housing 22 may form a unitary one-piece structure so that an EGR valve assembly and a bypass valve assembly 30 may be integrally mounted in the inlet header 12. The EGR valve assembly may be mounted in the EGR valve housing 21, and the EGR valve housing 21 may have a valve cavity 21*a* in which a valve member of the EGR valve assembly is movably mounted. The valve member of the EGR valve assembly may adjust the opening amount of the valve cavity 21*a* to thereby adjust the flow rate of an exhaust gas into the EGR cooler 10. The bypass valve assembly 30 may be mounted in the bypass valve housing 22, and the bypass valve assembly 30 may be configured to switch the flow of the exhaust gas into the bypass conduit 18 or the housing 11.

Figure 6:
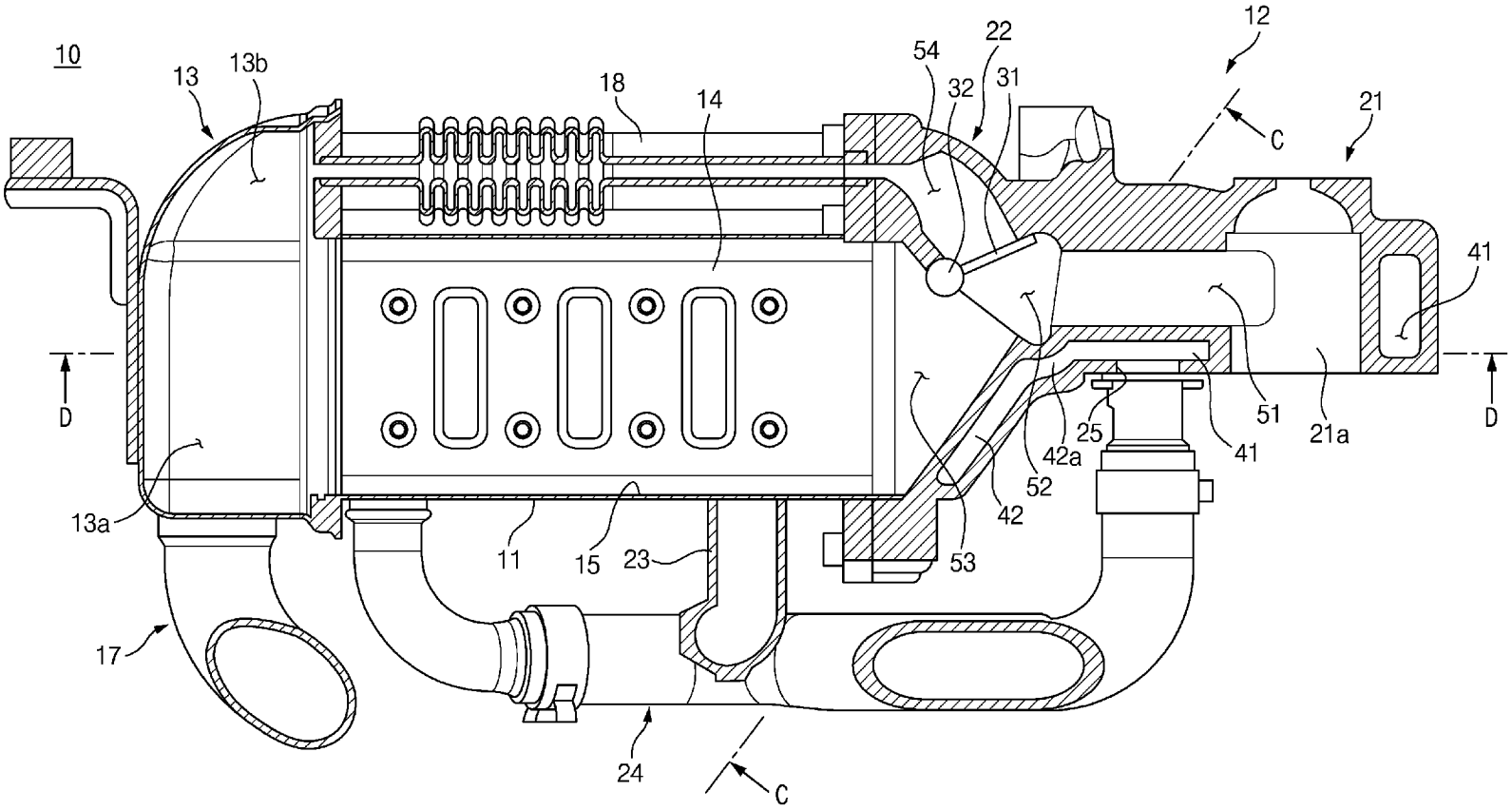
FIG. 6 illustrates a cross-sectional view, taken along line B-B of FIG. 2.

Referring to FIG. 6, the inlet header 12 may have a plurality of inlet passages 51, 52, 53, and 54 defined therein, and the plurality of inlet passages 51, 52, 53, and 54 may allow the exhaust gas to flow between the housing 11 and the bypass conduit 18. The plurality of inlet passages 51, 52, 53, and 54 may include a first inlet passage 51 directly fluidically-communicating with the valve cavity 21*a* of the EGR valve housing 21, a second inlet passage 52 directly fluidically-communicating with the first inlet passage 51, a third inlet passage 53 located between the second inlet passage 52 and the cavity 15 of the housing 11, and a fourth inlet passage 54 located between the second inlet passage 52 and the bypass conduit 18. The first inlet passage 51 may be defined in the EGR valve housing 21, and the second inlet passage 52, the third inlet passage 53, and the fourth inlet passage 54 may be defined in the bypass valve housing 22. The third inlet passage 53 and the fourth inlet passage 54 may branch off from the second inlet passage 52, and the third inlet passage 53 may directly fluidically-communicate with an inlet of each tube 14. The fourth inlet passage 54 may directly fluidically-communicate with the bypass conduit 18. The plurality of inlet passages 51, 52, 53, and 54 may be fluidly separated from cooling chambers 41 and 42.

Referring to FIG. 6, an outlet header 13 may be sealingly mounted on a second end portion of the housing 11, and the outlet header 13 may have a first outlet passage 13*a* and a second outlet passage 13*b* provided therein. The first outlet passage 13 a may directly fluidically-communicate with the cavity 15 of the housing 11, and the first outlet passage 13*a* may directly fluidically-communicate with an outlet of each tube 14. The second outlet passage 13*b* may directly fluidically-communicate with an outlet of the bypass conduit 18. An exhaust gas outlet conduit 17 may be connected to the outlet header 13.

In an exemplary embodiment of the present invention, the exhaust gas outlet conduit 17 is connected to the first outlet passage 13*a* and the second outlet passage 13*b* of the outlet header 13.

The inlets of the tubes 14 may be sealingly mounted to the inlet header 12 through a sealing system, and the outlets of the tubes 14 may be sealingly mounted to the outlet header 13 through a sealing system.

Figure 2:
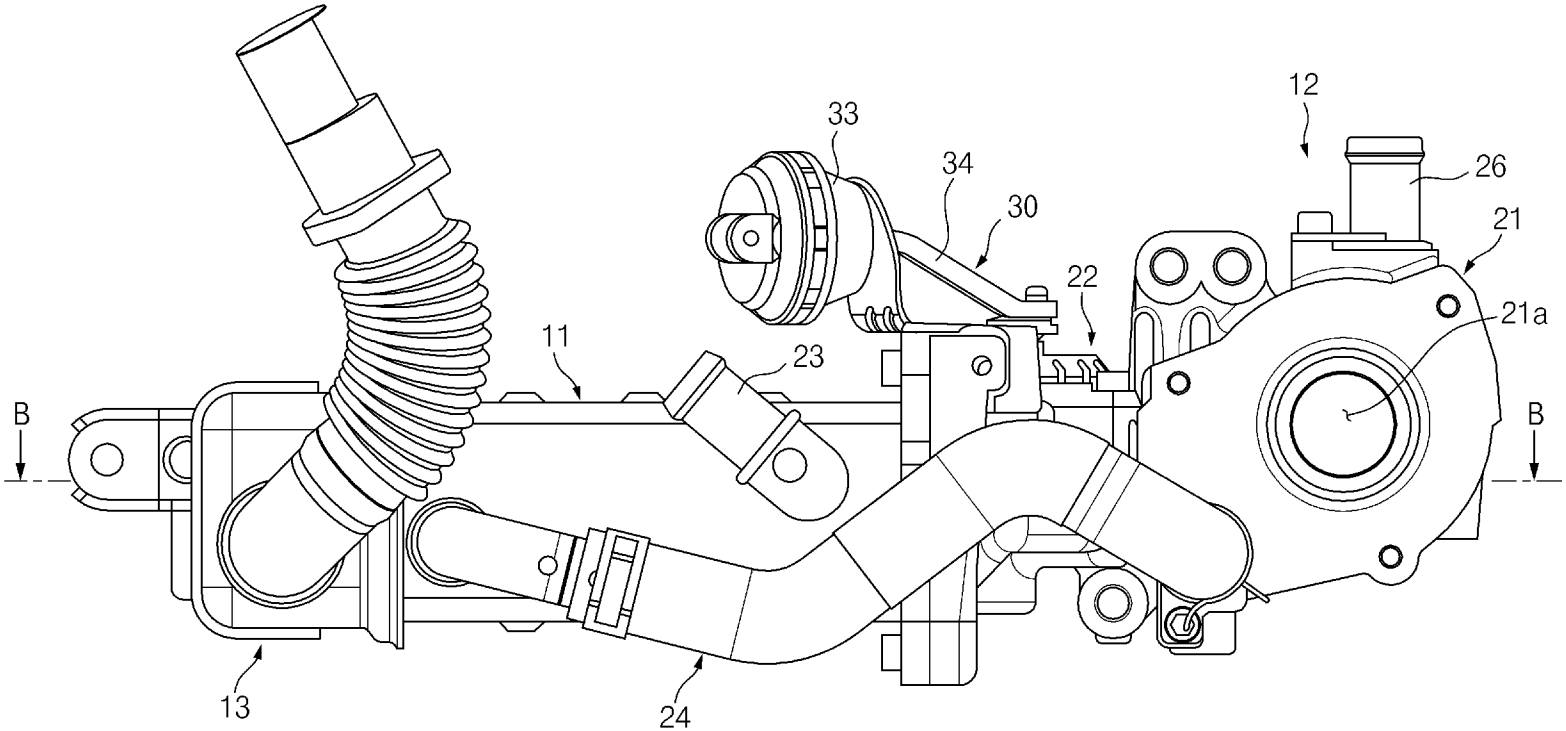
FIG. 2 illustrates a view, which is viewed in a direction indicated by arrow A of FIG. 1.

Referring to FIG. 1 and FIG. 2, a coolant inlet conduit 23 and a coolant outlet conduit 24 may be fluidly connected to the cavity 15 of the housing 11. The coolant inlet conduit 23 may directly fluidically-communicate with an inlet of the cavity 15 of the housing 11, and the coolant outlet conduit 24 may directly fluidically-communicate with an outlet of the cavity 15 of the housing 11. The coolant inlet conduit 23 and the coolant outlet conduit 24 may be fluidly connected to a water jacket of an internal combustion engine. The coolant may be directed to the inlet of the cavity 15 of the housing 11 through the coolant inlet conduit 23, and the coolant may pass through the gap between the tubes 14 in the cavity 15 so that the exhaust gas passing through the inside of the tubes 14 may be cooled. The coolant may be discharged to the coolant outlet conduit 24 through the outlet of the cavity 15 of the housing 11.

Figure 4:
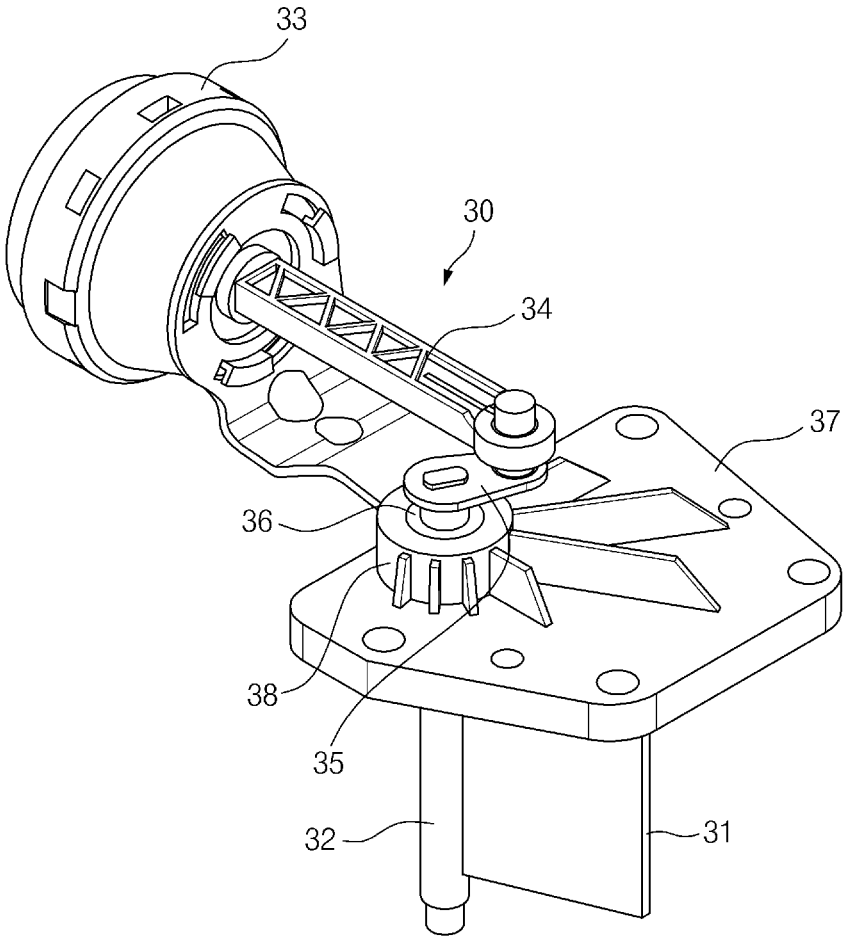
FIG. 4 illustrates a perspective view of a bypass valve assembly according to an exemplary embodiment of the present disclosure.

Referring to FIG. 4, the bypass valve assembly 30 may include a valve flap 31, a valve shaft 32 provided on the valve flap 31, and an actuator 33 connected to the valve shaft 32 through a drive link 34 and a driven link 35.

Referring to FIG. 6, the valve flap 31 may be movably mounted in the second inlet passage 52, and the valve flap 31 may selectively cover the third inlet passage 53 and the fourth inlet passage 54. The valve flap 31 may move between a closed position in which the valve flap 31 uncovers the third inlet passage 53 and covers the fourth inlet passage 54 and an open position in which the valve flap 31 covers the third inlet passage 53 and uncovers the fourth inlet passage 54. When the valve flap 31 moves to the closed position, the exhaust gas may pass through the tubes 14 in the housing 11 without flowing into the bypass conduit 18, and thus the exhaust gas may be cooled by the coolant. When the valve flap 31 moves to the open position, the exhaust gas may be directed into the bypass conduit 18 so that the exhaust gas may bypass the tubes 14 of the housing 11.

The valve shaft 32 may be integrally formed with the valve flap 31, and the valve shaft 32 may be rotatably supported to the bypass valve housing 22.

The drive link 34 may be configured to move linearly by the actuator 33, and the driven link 35 may be configured to connect between the drive link 34 and the valve shaft 32. As the drive link 34 moves, the driven link 35 may pivot along a predetermined trajectory, and thus the valve shaft 32 may rotate around its central axis.

Figure 5:
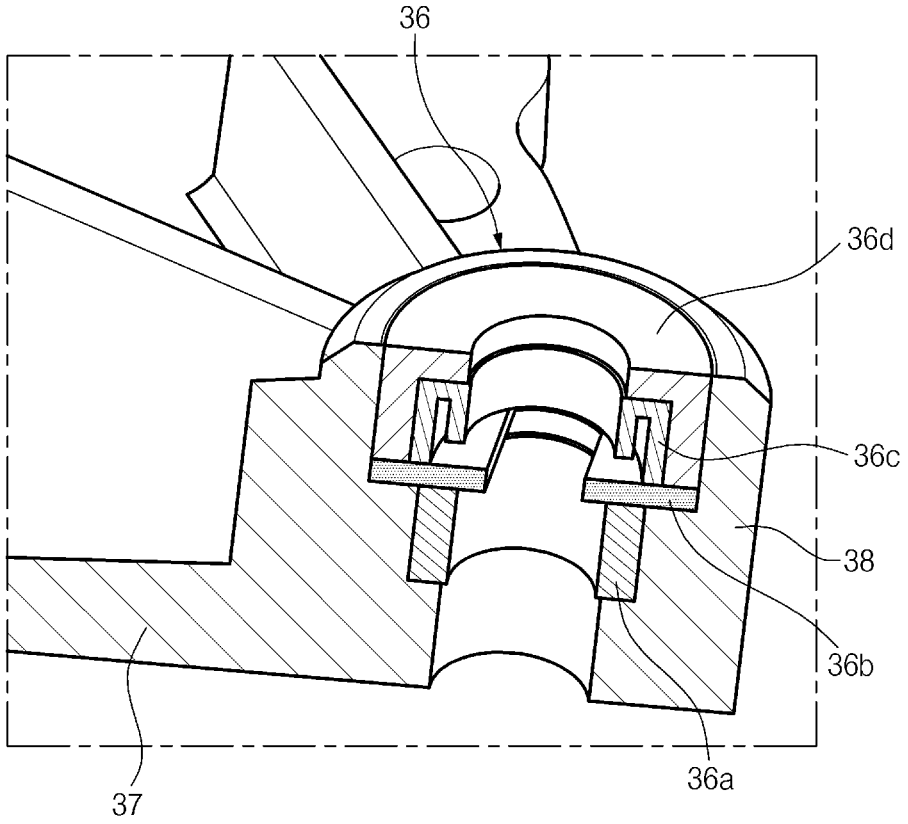
FIG. 5 illustrates a cut-away perspective view of a sealing system mounted in a support boss illustrated in FIG. 4.

The bypass valve assembly 30 may further include a valve cover 37 detachably mounted on the bypass valve housing 22 through a fastener. The valve cover 37 may have a support boss 38, and one end portion of the valve shaft 32 may be rotatably supported to the support boss 38 through a sealing system 36. Referring to FIG. 5, the sealing system 36 may include a bushing 36*a* mounted on an internal surface of the support boss 38, a washer 36*b* accommodated on the bushing 36*a*, and a first seal member 36*c* and a second seal member 36*d* located on the washer 36*b*. The first seal member 36*c* and the second seal member 36*d* may be made of an elastic material such as rubber.

Figure 3:
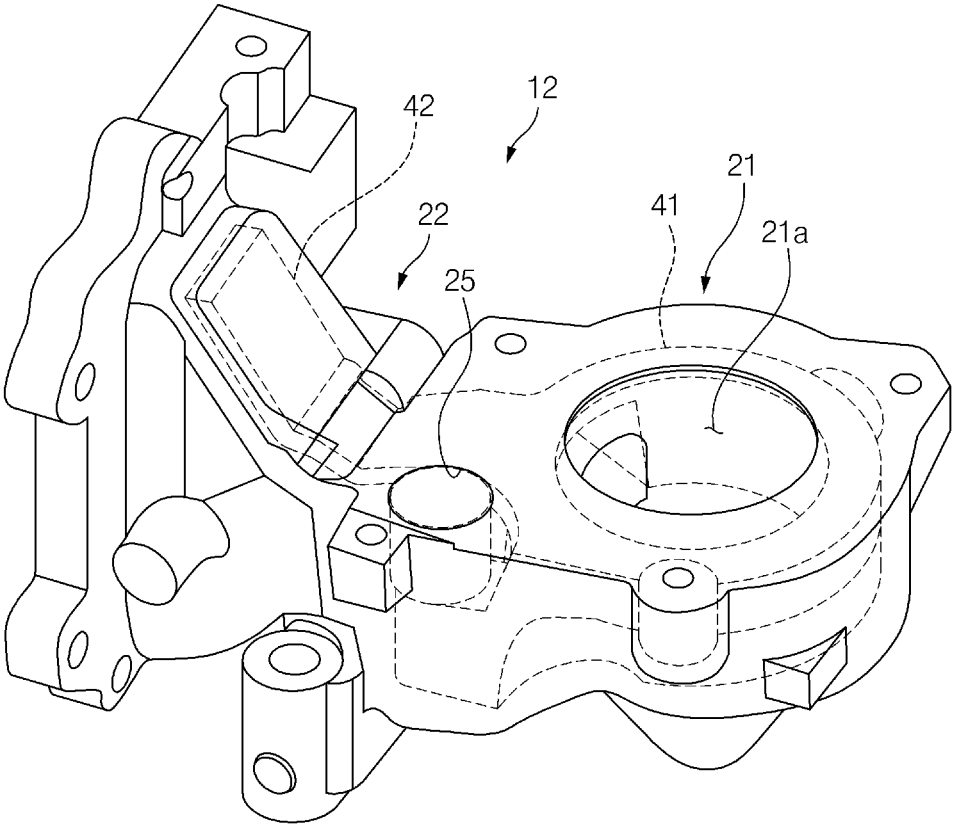
FIG. 3 illustrates a perspective view of an inlet header of an EGR cooler according to an exemplary embodiment of the present disclosure.
Figure 7:
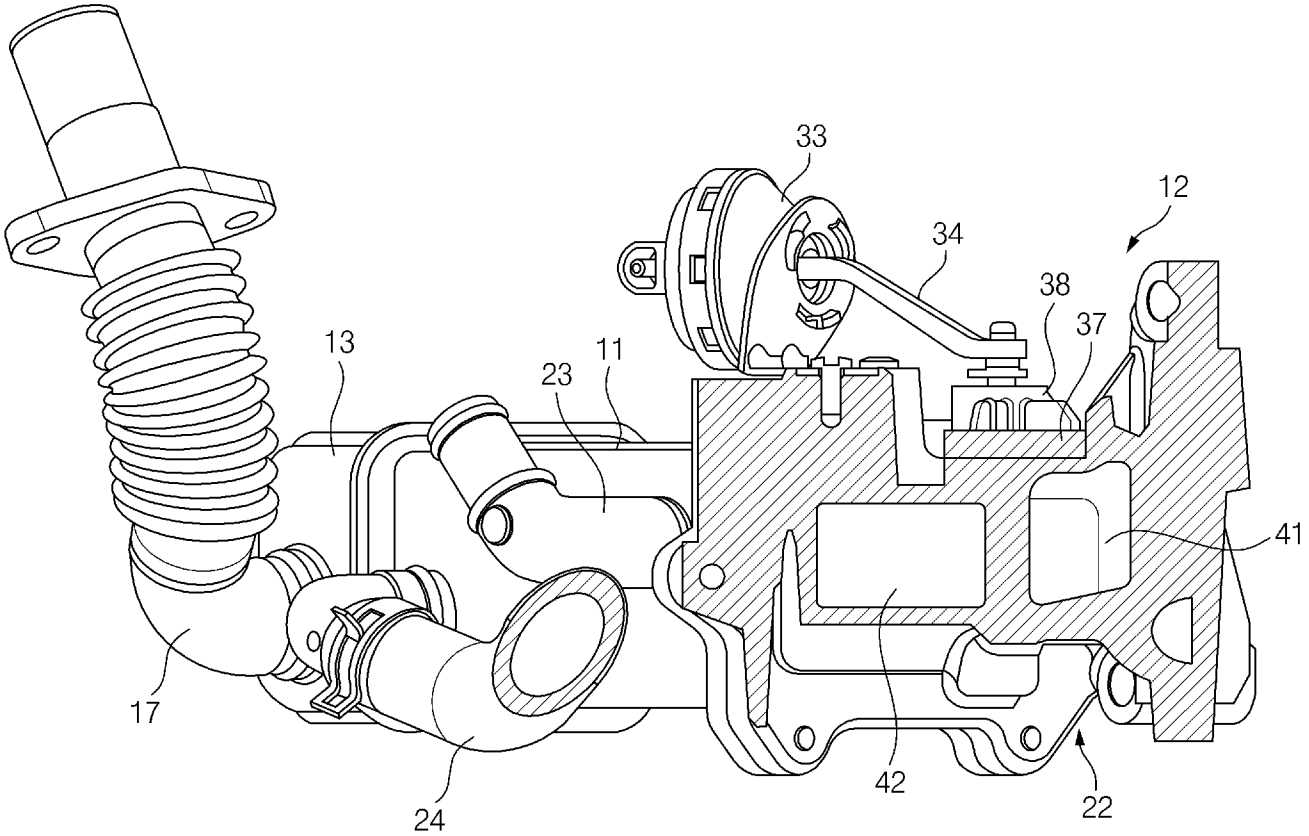
FIG. 7 illustrates a cross-sectional view, taken along line C-C of FIG. 6.
Figure 9:
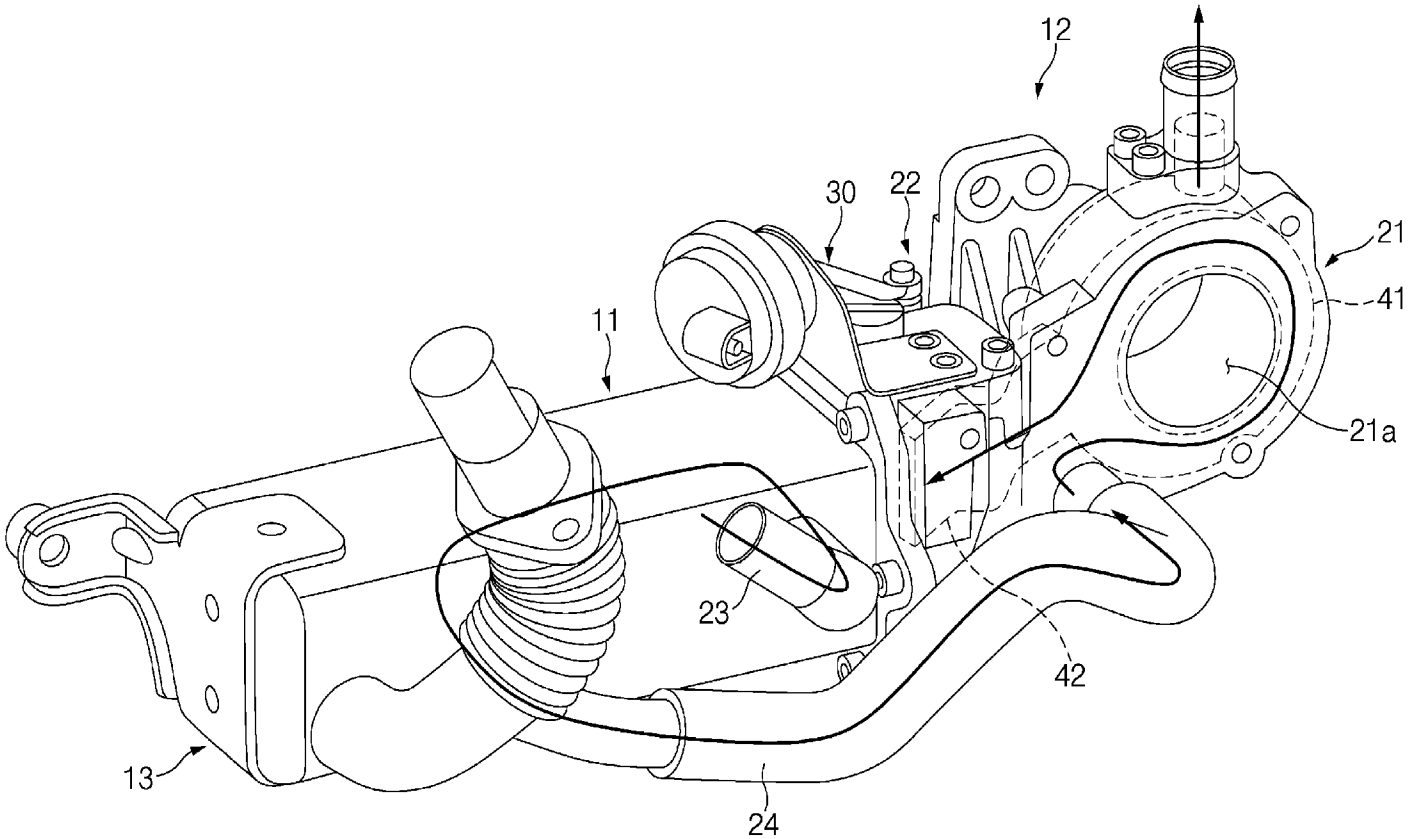
FIG. 9 illustrates a perspective view of an EGR cooler according to an exemplary embodiment of the present disclosure.

Referring to FIG. 3, the inlet header 12 may include a first cooling chamber 41 defined in the EGR valve housing 21, and a second cooling chamber 42 defined in the bypass valve housing 22. Referring to FIG. 8, the first cooling chamber 41 may have an inlet 25 and an outlet 26, and the first cooling chamber 41 may be provided to surround the valve cavity 21*a* within the EGR valve housing 21. Referring to FIGS. 6 to 8, the second cooling chamber 42 may extend from the first cooling chamber 41 toward the housing 11. The second cooling chamber 42 may extend obliquely to match an inclined surface of the bypass valve housing 22, and accordingly the second cooling chamber 42 may be inclined with respect to the first cooling chamber 41 at a predetermined angle. The first cooling chamber 41 may be fluidly connected to the second cooling chamber 42. The inlet 25 of the first cooling chamber 41 may be fluidly connected to the coolant outlet conduit 24, and the outlet 26 of the first cooling chamber 41 may be fluidly connected to the water jacket of the internal combustion engine. Referring to FIG. 9 (see the directions of arrows), the coolant may be directed into the housing 11 through the coolant inlet conduit 23, and flow from the housing 11 to the first cooling chamber 41 through the coolant outlet conduit 24, and then the coolant having passed through the first cooling chamber 41 may be directed into the second cooling chamber 42. The coolant having passed through the first cooling chamber 41 and the second cooling chamber 42 may be directed into the water jacket of the internal combustion engine through the outlet 26.

Referring to FIG. 6, the second cooling chamber 42 may be configured to at least partially surround the second inlet passage 52 and the third inlet passage 53 defined in the bypass valve housing 22. The second cooling chamber 42 may have a curved portion 42*a* which is curved to surround a portion of the second inlet passage 52. The valve shaft 32 may be rotatably provided between the second inlet passage 52 and the third inlet passage 53 of the bypass valve housing 22, and the curved portion 42*a* may be configured to partially surround the second inlet passage 52 and the third inlet passage 53. Accordingly, the curved portion 42*a* may be configured to indirectly surround the valve shaft 32 through the second inlet passage 52 and the third inlet passage 53. The curved portion 42*a* may be provided between the first cooling chamber 41 and the second cooling chamber 42 to connect the first cooling chamber 41 and the second cooling chamber 42 at a predetermined angle.

When the EGR valve assembly is opened to a predetermined degree, the exhaust gas may be directed into the first inlet passage 51, the second inlet passage 52, and the third inlet passage 53 of the inlet header 12, regardless of the position of the valve flap 31 of the bypass valve assembly 30. Accordingly, the EGR valve housing 21 and the bypass valve housing 22 of the inlet header 12 may be in direct thermal contact with the exhaust gas, and the components of the EGR valve assembly and the components of the bypass valve assembly 30 may be thermally affected by the exhaust gas. To deal with this, as the coolant passes through the first cooling chamber 41 and the second cooling chamber 42, the EGR valve housing 21 and the bypass valve housing 22 may be cooled simultaneously, and thus the components of the EGR valve assembly and the components of the bypass valve assembly 30 may be prevented from being thermally deformed.

According to the above-described exemplary embodiment of the present disclosure, as the coolant passes through the first cooling chamber 41 and the second cooling chamber 42, the bypass valve housing 22 and the valve cover 37 may be cooled by the coolant. Accordingly, the valve shaft 32 and the sealing system 36 may be properly cooled. The sealing system 36 may be properly cooled by the coolant so that the sealing system 36 may be prevented from being thermally deformed by the exhaust gas, and thus leakage of the exhaust gas may be reliably prevented.

Furthermore, the first cooling chamber 41 and the second cooling chamber 42 may form a unitary one-piece structure. The first cooling chamber 41 may be integrally formed in the EGR valve housing 21, and the second cooling chamber 42 may be integrally formed in the bypass valve housing 22, which may allow the pressure and flow rate of the coolant to be relatively increased compared to the related art. That is, the pressure, flow rate, and the like of the coolant may be variously adjusted in relatively wide ranges compared to the related art.

As set forth above, the EGR cooler according to exemplary embodiments of the present disclosure may minimize thermal damage to various components caused by the exhaust gas, and reliably prevent the leakage of the exhaust gas.

According to exemplary embodiments of the present disclosure, the inlet header may include the EGR valve housing and the bypass valve housing, and the EGR valve housing and the bypass valve housing may form a unitary one-piece structure so that the EGR valve and the bypass valve may be integrally mounted in the inlet header. Thus, the ease of assembly of the EGR valve and the bypass valve may be significantly improved.

According to exemplary embodiments of the present disclosure, as the coolant passes through the second cooling chamber, the bypass valve housing and the valve cover may be cooled by the coolant. Accordingly, the sealing system mounted in the support boss of the valve cover may be properly cooled. As the sealing system is properly cooled by the coolant, the sealing system may be prevented from being thermally deformed by the exhaust gas, and thus the leakage of the exhaust gas may be reliably prevented.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of predetermined exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. An exhaust gas recirculation (EGR) cooler, comprising:

a housing including a cavity in which a plurality of tubes are received, and including a coolant inlet conduit allowing a coolant to flow into the cavity therethrough and a coolant outlet conduit allowing the coolant to be discharged from the cavity therethrough;

a bypass conduit provided in parallel to the housing;

an inlet header mounted on a first end portion of the housing; and an outlet header mounted on a second end portion of the housing, wherein the inlet header includes an EGR valve housing and a bypass valve housing to which the bypass conduit is connected, wherein at least one cooling chamber is defined in the inlet header, and wherein the at least one cooling chamber is fluidly connected to the cavity of the housing through the coolant outlet conduit.

2. The EGR cooler of claim 1, wherein the at least one cooling chamber of the inlet header includes a first cooling chamber defined in the EGR valve housing, and a second cooling chamber defined in the bypass valve housing.

3. The EGR cooler of claim 2, wherein the EGR valve housing includes a valve cavity, and wherein the first cooling chamber is provided to surround the valve cavity within the EGR valve housing.

4. The EGR cooler of claim 2, wherein the second cooling chamber extends from the first cooling chamber toward the housing, and wherein the first cooling chamber is fluidly connected to the second cooling chamber.

5. The EGR cooler of claim 1, wherein the EGR valve housing and the bypass valve housing form a unitary one-piece structure, and wherein the bypass valve housing is located on a downstream side of the EGR valve housing in an exhaust gas flow direction.

6. The EGR cooler of claim 3, wherein the inlet header further includes:

a first inlet passage directly fluidically-communicating with the valve cavity of the EGR valve housing;

a second inlet passage directly fluidically-communicating with the first inlet passage;

a third inlet passage located between the second inlet passage and the cavity of the housing; and a fourth inlet passage located between the second inlet passage and the bypass conduit.

7. The EGR cooler of claim 6, wherein the third inlet passage and the fourth inlet passage branch off from the second inlet passage, wherein the third inlet passage directly fluidically-communicates with an inlet of each of the plurality of tubes, and wherein the fourth inlet passage directly fluidically-communicates with the bypass conduit.

8. The EGR cooler of claim 1, further including:

a bypass valve assembly mounted in the bypass valve housing, wherein the bypass valve assembly includes a valve flap, a valve shaft provided on the valve flap, and an actuator connected to the valve shaft.

9. The EGR cooler of claim 2, wherein the bypass valve assembly includes a valve shaft, and wherein the second cooling chamber includes a curved portion which is provided to surround the valve shaft located in the bypass valve housing.

10. The EGR cooler of claim 8, wherein the bypass valve assembly further includes a valve cover detachably mounted on the bypass valve housing through a fastener, and wherein the valve shaft is rotatably supported to the valve cover through a sealing system.

11. The EGR cooler of claim 6, wherein a valve flap provided in the bypass valve housing is movably mounted in the second inlet passage, and wherein the valve flap selectively covers the third inlet passage and the fourth inlet passage.

12. The EGR cooler of claim 11, wherein the valve flap moves between a closed position in which the valve flap uncovers the third inlet passage and covers the fourth inlet passage and an open position in which the valve flap covers the third inlet passage and uncovers the fourth inlet passage.

13. The EGR cooler of claim 11, further including:

a valve shaft provided on the valve flap, and an actuator connected to the valve shaft, wherein the second cooling chamber includes a curved portion which is provided to surround the valve shaft located in the bypass valve housing.

14. The EGR cooler of claim 1, wherein the outlet header includes:

a first outlet passage fluidically-communicating with the cavity of the housing and an outlet of each of the plurality of tubes; and a second outlet passage fluidically-communicating with an outlet of the bypass conduit, wherein an exhaust gas outlet conduit is connected to the first outlet passage and the second outlet passage of the outlet header.

* * * * *